United States Patent [19]

Kakinuma et al.

[11] Patent Number: 4,664,999

[45] Date of Patent: May 12, 1987

[54] METHOD OF MAKING ELECTROPHOTOGRAPHIC MEMBER WITH A-SI PHOTOCONDUCTIVE LAYER

[75] Inventors: Hiroaki Kakinuma; Hisashi Fukuda; Satoshi Nishikawa, all of Tokyo, Japan

[73] Assignee: OKI Electric Industry Co., Ltd., Tokyo, Japan

[21] Appl. No.: 787,367

[22] Filed: Oct. 15, 1985

[30] Foreign Application Priority Data

| | | | |
|---|---|---|---|
| Oct. 16, 1984 | [JP] | Japan | 59-216857 |
| Jun. 18, 1985 | [JP] | Japan | 60-130894 |
| Jun. 18, 1985 | [JP] | Japan | 60-130895 |
| Jul. 12, 1985 | [JP] | Japan | 60-152485 |

[51] Int. Cl.[4] ..... G03G 5/14

[52] U.S. Cl. ..... 430/67; 430/84

[58] Field of Search ..... 430/65, 84, 95, 128, 430/66, 67

[56] References Cited

U.S. PATENT DOCUMENTS

| | | | |
|---|---|---|---|
| 4,378,417 | 3/1983 | Maruyama et al. | 430/84 |
| 4,483,911 | 11/1984 | Ogawa et al. | 430/95 |

OTHER PUBLICATIONS

Yoshikazu Nakayama et al., "Stability of Amorphous Silicon Photoreceptor for Diode Laser Printer Application" pp. 1231–1234, *Journal of Non-Crystalline Solids* 59 and 60 (1983).

*Primary Examiner*—John L. Goodrow

*Attorney, Agent, or Firm*—Wenderoth, Lind & Ponack

[57] ABSTRACT

A method of making an electrophotographic member with an a-Si photoconductive layer and an a-c layer as a surface protecting layer is disclosed, wherein the a-c layer is deposited on the photoconductive layer; which a-c layer contains hydrogen or hydrogen and fluorine, and which layer is formed by a glow discharge method.

4 Claims, 10 Drawing Figures

METHOD OF MAKING ELECTROPHOTOGRAPHIC MEMBER WITH A-SI PHOTOCONDUCTIVE LAYER

BACKGROUND OF THE INVENTION

1. Field of the Invention

This invention relates to a method of making an electrophotographic member with an amorphous Silicon photoconductive layer and a surface protecting layer of amorphous carbon as a principal ingredient, such as amorphous carbon layer containing hydrogen or amorphous carbon layer containing hydrogen and fluorine.

2. Brief Description of Related Art

The amorphous Silicon (hereinafter abbreviated as "a-Si") photoconductive layer has several advantages compared with conventional chalcogenides such as a-Se, a-Se-Te, and a-$As_2Se_3$: high photosensitivity in the long wavelength range, high mechanical durability due to its hardness, high thermal stability and no harm to the environment. Because of these features the a-Si photoconductive layer is suitable for maintenance-free copying machines and highspeed printers.

The preparation of the electrophotographic member with the a-Si photoconductive layer was reported by Yoshikazu Nakayama, et al in the Journal of Non-crystalline Solids, 59 and 60 (1983), pages 1231–1234, published by North-Holland publishing Company. Such an electrophotographic member has three layers; a blocking layer, a photoconductive layer and a surface protecting layer of a-SiOx: H. These layers are deposited in the above-stated order on an electrode substrate of cylindrical drum, and the surface protecting layer is provided to stabilize surface potential of the electrophotographic member and to improve the wetproofing as a result of the hydrophobic properties of the surface protecting layer.

However, such an electrophotographic member have defects in that the printing quality and the wetproofing deteriorate, because the hydrophobic properties and the surface resistivity of the surface protecting layer is lowered by the repetition of the corona charging and discharging.

SUMMARY OF THE INVENTION

The present invention has been made in view of the abovementioned various disadvantages inherent in the conventionally known electrophotographic member.

It is an object of the present invention to provide an electrophotographic member with a surface protecting layer which is provided to cover the surface of the a-Si photoconductive layer from receiving physical and chemical damages.

Another object of the present invention is to provide an electrophotographic member with the surface protecting layer having high hydrophobic properties and high surface resistivity against the repetition of corona charging and discharging.

A further object of the present invention is to provide an electrophotographic member with a surface protecting layer of uniform thickness and quality.

According to the present invention, there is provided a method for making an electrophotographic member with an a-Si photoconductive layer and a surface protecting layer which comprises:

(a) depositing a photoconductive layer of a-Si containing silicon as principal ingredient on a support such as an substrate cylindrical drum, (b) depositing an amorphous carbon layer, as a surface protecting layer, containing hydrogen (hereinafter abbreviated as "a-C:H") or containing hydrogen and fluorine (hereinafter abbreviated as "a-C:H, F") by the glow discharge decomposition of hydrocarbon gases, or hydrocarbon and fluorine gases, and (c) thereafter incorporating fluorine in the a-C:H layer by causing an electric discharge in fluorine containing gases as occasion demands.

The above and other objects, features and advantages of the present invention will become more apparent from the following description when taken in conjunction with the accompanying drawings in which preferred embodiments of the present invention are shown by way of illustrative example.

DETAILED DESCRIPTION OF A PREFERRED EMBODIMENT

The embodiments of the present invention will be described below.

Figure 1:
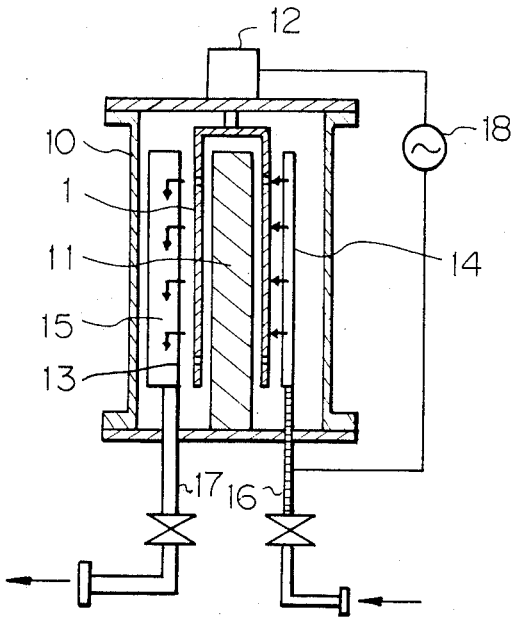
FIG. 1 is a cross-sectional view of an apparatus suitable for conducting the process for making an electrophotographic member according to the present invention.

Referring to the drawings, FIG. 1 is a cross sectional view of a conventional apparatus suitable for conducting the process for making an electrophotographic member according to the present invention. An a-Si containing hydrogen (hereinafter abbreviated as "a-Si:H") layer as a photoconductive layer can be deposited by conventional methods, and the method of deposition of the a-Si layer will be described below by reference to FIG. 1, to begin with.

In FIG. 1, reference numeral 10 indicates a cylindrical reaction chamber, reference numeral 11 indicates a heater for heating a substrate support 1 which is set up to rotate around the heater 11 reference numeral 12 indicates a motor to drive the substrate support 1, reference numeral 13 indicates an outer electrode having a has inlet 14 and a gas outlet 15, reference numeral 16 indicates a gas inflow pipe which is connected to the gas inlet 14 to supply the reaction chamber 10 with gases through mass flow controller, reference numeral 17 indicates a gas outflow pipe which is connected with the has outlet 15 to exhaust the reacted gases in the reaction chamber 10, and reference numeral 18 indicates a rf power source to supply rf power between the substrate support 1 and the outer electrode 13.

While gases in reaction chamber 10 is exhausted through the gas outlet 15, the substrate support 1 is rotated by the motor 12 and heated by the heater 11 to 200°-300° C. Under this condition, gases are introduced in the reaction chamber 10, which consist of a mixture of a silicon containing gas, a dopant gas and a conventional carrier gas. The silicon containing gas may comprise $SiH_4$, $Si_2H_6$, $SiCl_4$ and/or $SiF_4$. And an a-Si:H layer is deposited by the method of glow discharge under the conventional condition.

Further, the a-Si:H layer can be deposited by another method.

Thereafter, a surface protecting layer is deposited.

Figure 2:
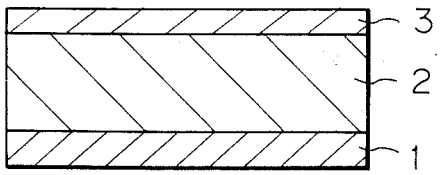
FIG. 2 is a cross-sectional view of an electrophotographic member according to a first embodiment of the present invention.

FIG. 2 is a cross-sectional view of an electrophotographic member according to a first embodiment of the present invention. After said a-Si:H layer 2 was deposited, by using the apparatus illustrated FIG. 1, the substrate support 1 is heated by the heater 11 and is rotated by the moter 12. The gases in the reaction chamber 10 are exhausted until the pressure is controlled 1 Pa or below. Thereafter the mixed gases of ethylene ($C_2H_4$) and helium (He) in the fixed mixture ratio are supplied in the reaction chamber 10.

Then keeping the Fixed mixture ratio an a-C:H layer 3 is deposited as shown FIG. 2 with a thickness of 100 Å-10 μm by the glow discharge method i.e. by plasma treating.

In this embodiment, the a-C:H layer 3 is deposited using the mixed gases of pure $C_2H_4$ and He in the fixed mixture ratio. Mixing He results in high efficiency and stability of the discharge decomposition, and hence a uniform thickness of the a-C:H layer 3.

Figure 3:
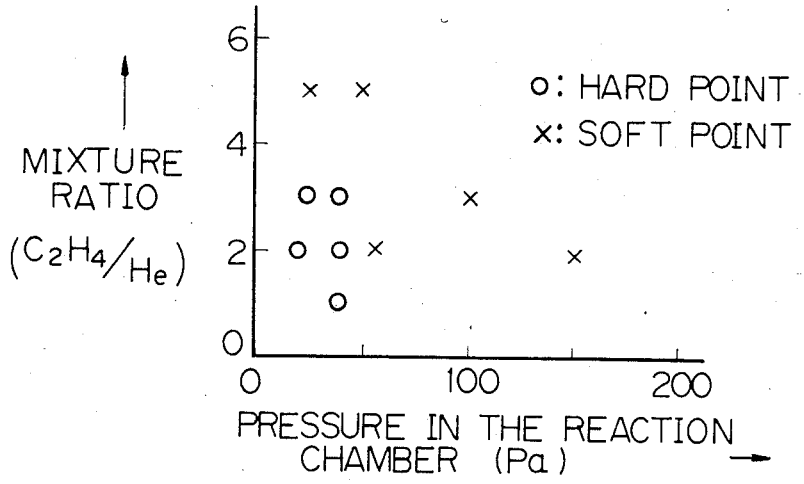
FIG. 3 is a graphical representation showing the hardness variation of a surface protecting layer according to the first embodiment of the present invention.
Figure 4A:
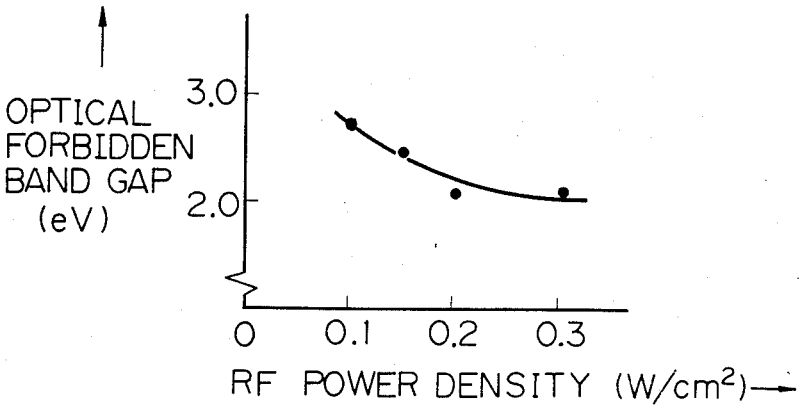
FIGS. 4(A) to 4(D) are graphical representations showing the character of the surface protecting layer according to the first embodiment of the present invention.
Figure 4B:
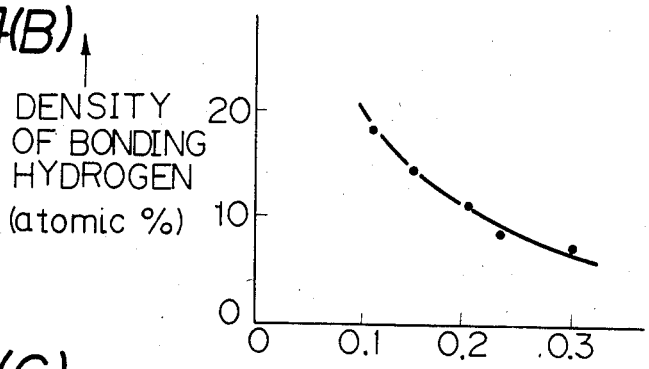
Figure 4C:
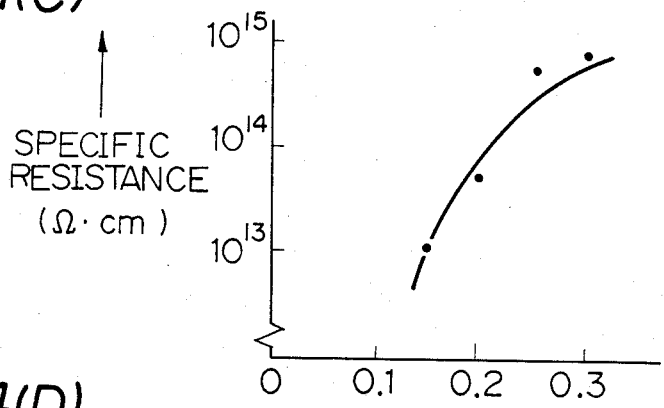
Figure 4D:
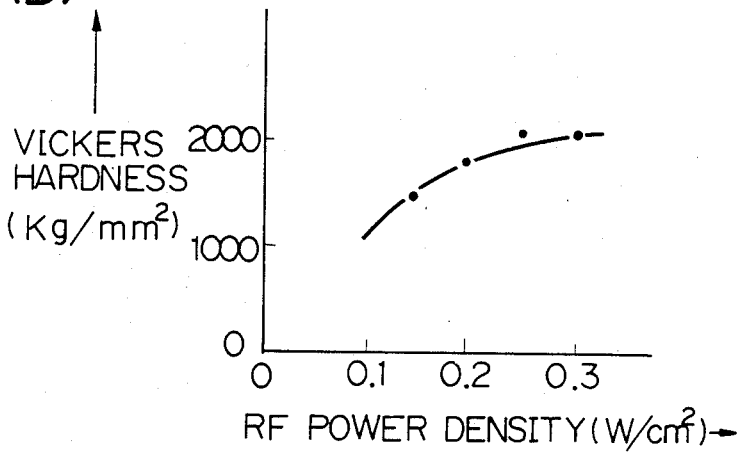

FIG. 3 is a graphical representation showing the hardness variation of said a-C:H layer 3 which is deposited at a temperature of 200° C. and at an rf power of 0.2 W/cm$^2$, for various values of pressure in the reaction chamber 10 and mixture ratio of $C_2H_4$/He. In FIG. 3 the circles and crosses indicate the hard points and soft points. FIG. 3 shows distinctly that the hard a-C:H layer 3 with about 2000 Kg/mm$^2$ Vickers hardness (hereinafter abbreviated as "Hv") can be obtained only in the range of from 20 to 40 Pa in a pressure and from 2 to 3 in the mixture ratio of $C_2H_4$/He. If the temperature of the substrate 1 is not higher than 100° C., the resultant a-C:H layer 3 becomes powdery, and is not lower than 300° C., the resultant a-C:H layer 3 becomes opaque. The hard a-C:H layer 3 cannot be obtained if the rf power is not higher than 0.2 W/cm$^2$. If the $C_2H_4$/He ratio is not more than 1 the resultant a-C:H layer 3 becomes uneven in thickness and is not less than 3 the resultant a-C:H layer 3 becomes soft in a manner described above.

FIGS. 4(A) to 4(D) are graphical representations showing the character of the a-C:H layer 3 deposited on a glass substrate to a thickness of 1 μm on under the condition that the glass substrate is heated to 200° C. deposition pressure in the reaction chamber 10 is controlled at 20 Pa, the $C_2H_4$/He ratio is controlled at 2, and the gases are decomposited by rf power density of 0.1-0.3 W/CM$^2$.

FIGS. 4(A) to 4(D) are graphical representations showing the rerationship between the rf power density (W/cm$^2$) on the X-axis and the optical forbidden band gap(eV), the density of bonded hydrogen (atomic %), the specific resistance (Ω·cm), and Hv(Kg/mm$^2$) each on the y-axis.

As evidenced in the foregoing description, the a-C:H layer 3 which is hard (not less than about 2000 Kg/mm$^2$ Vickers hardness), highly resistive (the resistivity of not less than $10^{13}$Ω·cm) and transparent (not less than 2.0 eV optical forbidden band gap), can be obtained only under condition of 100°-300° C. substrate support temperature, 20-40 Pa pressure, 2-3 mixture ratio of $C_2H_4$/He and not less than 0.2 W/cm$^2$ rf power density.

Figure 5:
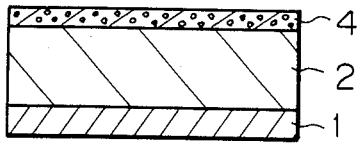
FIG. 5 is a cross-sectional view of an electrophotographic member according to a second embodiment of the present invention.

FIG. 5 is a cross-sectional view of an electrophotographic member according to a second embodiment of the present invention.

After said a-Si:H layer 2 was deposited on the substrate support 1 as mentioned before, an a-C containing hydrogen and fluorine (hereinafter abbreviated as "a-C:H,F") layer 4 as a surface protecting layer is deposited on the a-Si:H layer 2 by using the apparatus illustrated in FIG. 1.

After the gases in reaction chamber 10 are exhausted through the gas outlet 15, the gases containing at least hydrogen and carbon (CnHm; n, m are integral numbers) are introduced in the reaction chamber 10 and controlled at the fixed pressure. Rf power is applied and an a-C:H layer of the fixed thickness is deposited by the glow discharge method.

Then the gases in reaction chamber 10 are exhausted, and $CF_4$ gas is introduced to result in at 0.01-10 Torr pressure, and the a-C:H layer is treated by plasma generated by applying rf power of 0.01-1 W/cm$^2$ for 1-60 minutes so that CFn(n=1, 2, 3) belonging to a functional group are formed on the surface of the a-C:H layer and the a-C:H layer changes into an a-C:H, F layer 4. Although $CH_n$ can be formed by the plasma treating of about 1 minute, it is preferable to continue the treating for a longer time because, by doing so, the $CF_n$ develops into the depth of the a-C:H, F layer 4 is also etched and becomes thin by the plasma treating so that the plasma treating should not be continued longer than the necessary.

Figure 6:
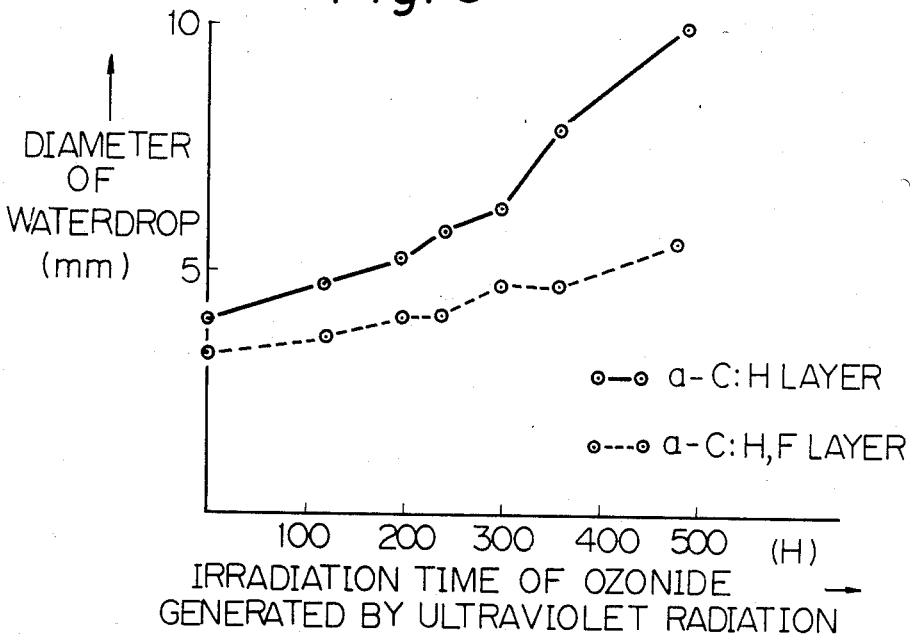
FIG. 6 is a graphical representation showing the hydrophobic properties of a surface protecting layer according to a second embodiment of the present invention.

FIG. 6 is a graphical representation showing the hydrophobic properties of the a-C:H layer 4 and showing the relationship between the irradiation time of an ozonide generated by an ultraviolet radiation on the X-axis and on the Y-axis the diameter of a waterdrop which is a measure of the hydrophobic properties when dropping a waterdrop of 0.01 cc on the surface of the a-C:H layer and a-C:H, F layer, accordingly the wider the diameter of a waterdrop is, the better the hydrophobic properties.

As evidence in FIG. 6, the hydrophobic properties of the a-C:H, F layer 4 is improved by $CF_4$ plasma treatment, and the wetproofing of the a-C:H, F layer 4 scarcely deteriorate by the ultraviolet radiation, as compared with the a-C:H layer.

It is considered that these advantages are effected by the CFn (n=1, 2, 3) made by the plasma treating, so that the gases containing fluorine such as $F_2$, $C_2F_6$, $CHF_3$, or CHCl $F_2$ may be used for the plasma treating.

Figure 7:
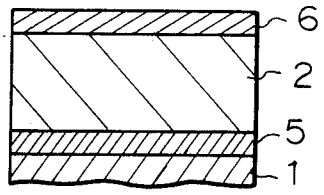
FIG. 7 is a cross-sectional view of an electrophotographic member according to a third embodiment of the present invention.

FIG. 7 is a cross-sectional view of an electrophotographic member according to a third embodiment of the present invention.

The resistivity of the a-Si:H layer 2 as a photoconductive layer is so low ($<10^{13}$ cm) that a blocking layer 5 such as a-Si$\times$C$_{1-x}$ layer is prepared between the substrate support 1 and the a-Si:H layer 2.

By using the apparatus illustrated in FIG. 1, the blocking layer 5 and the a-Si:H layer 2 are deposited in order on the substrate support 1 by conventional methods, thereafter an a-C:H, F layer 6 as a surface protecting layer is deposited on the a-Si:H layer 2.

After the reacted gases in the reaction chamber 10 are exhausted through the gas outflow pipe 17, gases containing carbon and hydrogen (Hydrocarbon: CnHm, n, m>1) such as $C_2H_4$ and gases containing fluorine (the gases at least one kind of gases selected from the group consisting of $CF_4$, $C_2F_6$, $CHF_3$ and $CHCl\ F_2$) such as $CF_4$ are mixed at fixed mixture ratio, and the mixed gases are suplied to the reaction chamber 10 through the gas inflow pipe 16, and then the a-C:H, F layer 6 is deposited by the glow discharge method.

Such a-C:H, F layer 6 contains both H and F not less than 0.1 atomic % less than 20 atomic %, having the features of $10^{14}$ C:H, F layer 6 deteriorates if it contains the H or F in amounts not less than 20 atomic %, however, the a-C:H, F layer 6 is deposited to contain both the H and F not less than 0.1 atomic % less than 20 atomic %, preferably about 10 atomic %, and is harder than a layer of resin or plastic, and capable of withstanding hundreds of thousands repetitions of corona charging and discharging operations.

In these embodiment as mentioned before, the a-Si:H layer 2, the a-C:H layer 3, the a-C:H, F layer 4, the blocking layer 5 and the a-C:H, F layer 6 can be deposited with ease by the same glow discharge method using the same apparatus under each condition.

Although certain preferred embodiments have been shown and described, it should be understood that many changes and modifications may be made therein without departing from the scope of the appended claims.

What is claimed is:

1. A method of forming an amorphous carbon surface layer as a protective layer over a photoconductive layer of amorphous silicon containing silicon as a principal ingredient, comprising the steps of:

(a) depositing said amorphous silicon photoconductive layer on a support; and (b) depositing an amorphous carbon layer consisting essentially of carbon and hydrogen as said surface layer to protect said photoconductive layer by the glow discharge decomposition of mixed gases of helium and ethylene.

2. A method according to claim 1, wherein said method of the glow discharge is effected under such conditions that said support temperature is in the range from 100° to 300° C., the pressure of the mixed gases in the range of from 20 to 40 Pa, the mixture ratio of said ethylene to said helium ($C_2H_4$/He) is in the range from 2 to 3 and rf power density is at least 0.2 W/cm$^2$.

3. A method of forming an amorphous carbon surface layer as a protective layer over a photoconductive layer of amorphous silicon containing silicon as a principal ingredient, comprising the steps of:

(a) depositing said photoconductive layer on a support; and (b) depositing an amorphous carbon layer consisting essentially of amorphous carbon and hydrogen as said surface layer to protect said photoconductive layer by glow discharge decomposition of gases containing at least a hydrocarbon; and (c) incorporating fluorine in said amorphous carbon layer by subjecting the amorphous carbon layer to a plasma discharge treatment with gases containing fluorine.

4. A method of forming an amorphous carbon surface layer as a protective layer over a photoconductive layer of amorphous silicon containing silicon as a principal ingredient, comprising the steps of:

(a) depositing said photoconductive layer on a support; and (b) depositing an amorphous carbon layer consisting essentially of amorphous carbon, hydrogen and fluorine as said surface layer to protect said photoconductive layer by the glow discharge of mixed gases containing hydrocarbon gases and fluorine compound gases.

* * * * *